US006124085A

United States Patent [19]

Hioki

[11] Patent Number: 6,124,085

[45] Date of Patent: Sep. 26, 2000

[54] SILVER HALIDE PHOTOGRAPHIC LIGHT-SENSITIVE MATERIAL AND NOVEL COMPOUND

[75] Inventor: Takanori Hioki, Kanagawa, Japan

[73] Assignee: Fuji Photo Film Co., Ltd., Kanagawa, Japan

[21] Appl. No.: 09/229,740

[22] Filed: Jan. 14, 1999

[30] Foreign Application Priority Data

Jan. 14, 1998 [JP] Japan ..... 10-005722

[51] Int. Cl.[7] ..... G03L 1/12

[52] U.S. Cl. ..... 430/584; 430/577; 430/581; 430/583; 430/585; 430/586; 430/587; 430/588

[58] Field of Search ..... 430/583, 577, 430/584, 586, 585, 587, 581, 588

[56] References Cited

U.S. PATENT DOCUMENTS 4,046,572 9/1977 Hinata et al. .
5,976,779 11/1999 Hioki ..... 430/583

FOREIGN PATENT DOCUMENTS 1567184 2/1968 France .
63-144344 6/1988 Japan .

*Primary Examiner*—Thorl Chea
*Attorney, Agent, or Firm*—Sughrue, Mion, Zinn, Macpeak & Seas, PLLC

[57] ABSTRACT

A silver halide photographic light-sensitive material is disclosed, comprising at least one compound represented by the following formula (I):

(I)

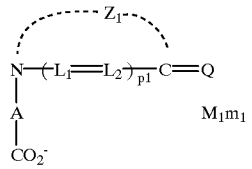

wherein A represents a divalent linking group containing at least one atom other than a carbon atom, $Z_1$ represents an atomic group necessary for forming a 5- or 6-membered nitrogen-containing heterocyclic ring, provided that the ring may further be condensed with an aromatic ring, $L_1$ and $L_2$ each represents a methine group, $p_1$ represents 0 or 1, $M_1$ represents a charge balancing counter ion, $m_1$ represents a number of from 0 to 10 necessary for neutralizing the charge of the molecule, and Q represents a group necessary for forming a methine dye.

3 Claims, No Drawings

SILVER HALIDE PHOTOGRAPHIC LIGHT-SENSITIVE MATERIAL AND NOVEL COMPOUND

FIELD OF THE INVENTION

The present invention relates to a novel compound and a silver halide photographic light-sensitive material containing the novel compound, more specifically, the present invention relates to a silver halide photographic light-sensitive material having high sensitivity and excellent storability and reduced in fog and residual color.

BACKGROUND OF THE INVENTION

In order to obtain high sensitivity and reduce residual coloration after the processing (residual color) of a silver halide photographic light-sensitive material, a great deal of efforts have heretofore been made. Sensitizing dyes used for spectral sensitization are known to have great effect on the capabilities of a silver halide photographic light-sensitive material. Even a very small difference in the structure of sensitizing dyes greatly affects the photographic capabilities such as sensitivity, fog and storage storability and it is difficult to anticipate the effect beforehand. Many researchers have conventionally synthesized a large number of sensitizing dyes and examined photographic capabilities thereof. As the sensitizing dye, those having a partial structure of a nitrogen-containing heterocyclic ring having a carboxyalkyl group are commonly used. Well known examples of the carboxyalkyl group include a carboxymethyl group, a 2-carboxyethyl group and a 3-carboxypropyl group. Carboxyalkyl groups other than these are, however, little studied and their effect on the photographic capabilities cannot be actually estimated at all at present.

Under these circumstances, sensitizing dyes capable of spectral sensitization while attaining high sensitivity without causing any adverse effect such as fog and reducing the residual color have heretofore been demanded.

SUMMARY OF THE INVENTION

An object of the present invention is to provide a novel compound.

Another object of the present invention is to provide a silver halide light-sensitive material containing the novel compound, having high sensitivity and excellent storability and reduced in fog and residual color.

As a result of extensive investigations, the objects of the present invention can be attained by the following inventions (1), (2) and (3):

(1) a silver halide photographic light-sensitive material comprising at least one compound represented by the following formula (I):

(I)

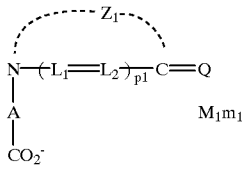

wherein A represents a divalent linking group containing at least one atom other than a carbon atom, $Z_1$ represents an atomic group necessary for forming a 5- or 6-membered nitrogen-containing heterocyclic ring, provided that the ring may further be condensed with an aromatic ring, $L_1$ and $L_2$ each represents a methine group, $p_1$ represents 0 or 1, $M_1$ represents a charge balancing counter ion, $m_1$ represents a number of from 0 to 10 necessary for neutralizing the molecular charge, and Q represents a group necessary for forming a methine dye;

(2) the silver halide photographic light-sensitive material as described in (1) above, wherein in the compound represented by formula (I), A is represented by $A_1$, provided that the compound represented by formula (I) is not a trinuclear merocyanine:

(I)

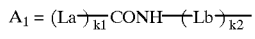

wherein La and Lb each represents a methylene group and $k_1$ and $k_2$ each represents an integer of from 0 to 10; and (3) a compound represented by formula (I) described in (2) above.

DETAILED DESCRIPTION OF THE INVENTION

The compound of the present invention is described in detail below.

Q may form any methine dye but preferably forms a cyanine dye, a merocyanine dye, a rhodacyanine dye, a trinuclear merocyanine dye, an allopolar dye, a hemicyanine dye or a styryl dye. These dyes are described in detail in F. M. Harmer, *Heterocyclic Compounds—Cyanine Dyes and Related Compounds,* D. M. Surmer, *Heterocyclic Compounds—Special Topics in Heterocyclic Chemistry,* Chap. 18, Para. 14, pp. 482–515, John Wiley & Sons (1964), and the like.

The cyanine dye, merocyanine dye and rhodacyanine dye are preferably represented by formulae (XI), (XII) and (XIII), respectively, described in U.S. Pat. No. 5,340,694, pages 21 and 22.

When Q forms a cyanine dye, formula (I) may be expressed by the following resonance formula:

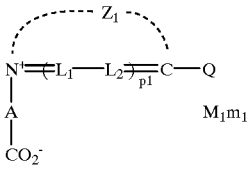

In formula (I), the 5- or 6-membered nitrogen-containing ring represented by $Z_1$ may be condensed with an aromatic ring. The aromatic ring may be a benzene ring, a naphthalene ring or a heteroaromatic ring such as pyrazine ring or thiophene ring.

Examples of the heterocyclic ring include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

Of these, preferred are a benzoxazole nucleus, a benzothiazole nucleus, a benzimidazole nucleus and a quinoline nucleus, more preferred are a benzoxazole nucleus and a benzothiazole nucleus.

Assuming that a substituent on $Z_1$ is V, the substituent represented by V is not particularly limited, however, examples thereof include a halogen atom (e.g., chlorine, bromine, iodine, fluorine), a mercapto group, a cyano group, a carboxyl group, a phoshoric acid group, a sulfo group, a hydroxyl group, a carbamoyl group having from 1 to 10 carbon atoms, preferably from 2 to 8 carbon atoms, more preferably from 2 to 5 carbon atoms (e.g., methylcarbamoyl, ethylcarbamoyl, morpholinocarbonyl), a sulfamoyl group having from 0 to 10 carbon atoms, preferably from 2 to 8 carbon atoms, more preferably from 2 to 5 carbon atoms (e.g., methylsulfamoyl, ethylsulfamoyl, piperidinosulfonyl), a nitro group, an alkoxy group having from 1 to 20 carbon atoms, preferably from 1 to 10 carbon atoms, more preferably from 1 to 8 carbon atoms (e.g., methoxy, ethoxy, 2-methoxyethoxy, 2-phenylethoxy), an aryloxy group having from 6 to 20 carbon atoms, preferably from 6 to 12 carbon atoms, more preferably from 6 to 10 carbon atoms (e.g., phenoxy, p-methylphenoxy, p-chlorophenoxy, naphthoxy), an acyl group having from 1 to 20 carbon atoms, preferably from 2 to 12 carbon atoms, more preferably from 2 to 8 carbon atoms (e.g., acetyl, benzoyl, trichloroacetyl), an acyloxy group having from 1 to 20 carbon atoms, preferably from 2 to 12 carbon atoms, more preferably from 2 to 8 carbon atoms (e.g., acetyloxy, benzoyloxy), an acylamino group having from 1 to 20 carbon atoms, preferably from 2 to 12 carbon atoms, more preferably from 2 to 8 carbon atoms (e.g., acetylamino), a sulfonyl group having from 1 to 20 carbon atoms, preferably from 1 to 10 carbon atoms, more preferably from 1 to 8 carbon atoms (e.g., methanesulfonyl, ethanesulfonyl, benzenesulfonyl), a sulfinyl group having from 1 to 20 carbon atoms, preferably from 1 to 10 carbon atoms, more preferably from 1 to 8 carbon atoms (e.g., methanesulfinyl, benzenesulfinyl), a sulfonylamino group having from 1 to 20 carbon atoms, preferably from 1 to 10 carbon atoms, more preferably from 1 to 8 carbon atoms (e.g., methanesulfonylamino, ethanesulfonylamino, benzenesulfonylamino), an amino group, a substituted amino group having from 1 to 20 carbon atoms, preferably from 1 to 12 carbon atoms, more preferably from 1 to 8 carbon atoms (e.g., methylamino, dimethylamino, benzylamino, anilino, diphenylamino), an ammonium group having from 0 to 15 carbon atoms, preferably from 3 to 10 carbon atoms, more preferably from 3 to 6 carbon atoms (e.g., trimethylammonium, triethylammonium), a hydrazino group having from 0 to 15 carbon atoms, preferably from 1 to 10 carbon atoms, more preferably from 1 to 6 carbon atoms (e.g., trimethylhydrazino), a ureido group having from 1 to 15 carbon atoms, preferably from 1 to 10 carbon atoms, more preferably from 1 to 6 carbon atoms (e.g., ureido, N,N-dimethylureido), an imido group having from 1 to 15 carbon atoms, preferably from 1 to 10 carbon atoms, more preferably from 1 to 6 carbon atoms (e.g., succinimido), an alkyl- or arylthio group having from 1 to 20 carbon atoms, preferably from 1 to 12 carbon atoms, more preferably from 1 to 8 carbon atoms (e.g., methylthio, ethylthio, carboxyethylthio, sulfobutylthio, phenylthio), an alkoxycarbonyl group having from 2 to 20 carbon atoms, preferably from 2 to 12 carbon atoms, more preferably from 2 to 8 carbon atoms (e.g., methoxycarbonyl, ethoxycarbonyl, benzyloxycarbonyl), an aryloxycarbonyl group having from 6 to 20 carbon atoms, preferably from 6 to 12 carbon atoms, more preferably from 6 to 8 carbon atoms (e.g., phenoxycarbonyl), an unsubstituted alkyl group having from 1 to 18 carbon atoms, preferably from 1 to 10 carbon atoms, more preferably from 1 to 5 carbon atoms (e.g., methyl, ethyl, propyl, butyl), a substituted alkyl group having from 1 to 18 carbon atoms, preferably from 1 to 10 carbon atoms, more preferably from 1 to 5 carbon atoms (e.g., hydroxymethyl, trifluoromethyl, benzyl, carboxyethyl, ethoxycarbonylmethyl, acetylaminomethyl; the substituted alkyl group also includes an unsaturated hydrocarbon group preferably having from 2 to 18 carbon atoms, more preferably from 3 to 10 carbon atoms, still more preferably from 3 to 5 carbon atoms (e.g., vinyl, ethynyl, 1-cyclohexenyl, benzylidine, benzylidene)), a substituted or unsubstituted aryl group having from 6 to 20 carbon atoms, preferably from 6 to 15 carbon atoms, more preferably from 6 to 10 carbon atoms (e.g., phenyl, naphthyl, p-carboxyphenyl, p-nitrophenyl, 3,5-dichlorophenyl, p-cyanophenyl, m-fluorophenyl, p-tolyl) and a heterocyclic group having from 1 to 20 carbon atoms, preferably from 2 to 10 carbon atoms, more preferably from 4 to 6 carbon atoms, which may be substituted (e.g., pyridyl, 5-methylpyridyl, thienyl, furyl, morpholino, tetrahydrofurfuryl). Furthermore, the substituent may have a structure condensed with a benzene ring, a naphthalene ring or an anthracene ring.

The substituent described above may be further substituted by V.

Of the above-described substituents, the substituent on $Z_1$ is preferably an alkyl group, an aryl group, an alkoxy group, a halogen atom, an acyl group, cyano group, a sulfonyl group or a benzene ring condensate, more preferably an alkyl group, an aryl group, a halogen atom, an acyl group, a sulfonyl group or a benzene ring condensate, still more preferably a methyl group, a phenyl group, a methoxy group, a chlorine atom, a bromine atom, an iodine tom or a benzene ring condensate, and most preferably a phenyl group, a chlorine atom, a bromine atom or an iodine atom.

The methine group represented by $L_1$ or $L_2$ may have a substituent and examples of the substituent include the substituents described above for V. The methine group is preferably an unsubstituted methine group.

$p_1$ is 0 or 1 and preferably 0.

$M_1$ is included in the formula for showing the presence of a cation or anion necessary for neutralizing the ion charge of a dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic ion such as ammonium ion (e.g., ammonium ion, tetraalkylammonium ion, pyridinium ion, ethylpyridinium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, other dyes having a charge reverse to that of an ionic polymer or dye may be used. Furthermore, when $CO_2^-$ or $SO_3^-$ has hydrogen ion as a counter ion, these may be expressed as $CO_2H$ and $SO_3H$, respectively.

$m_1$ represents a number necessary for balancing the charge and when an inner salt is formed, $m_1$ is 0.

In formula (I), A may be any linking group as far as it is a divalent linking group having at least one atom other than a carbon atom, however, A is preferably a linking group shown below:

$A_{11}$ = —(AA$_1$)—CH(OH)—(AA$_2$)—

$A_{12}$ = —(AA$_1$)—Ya—(AA$_2$)—

$A_{13}$ = —(AA$_1$)—C(=O)NH—(AA$_2$)—

$A_{14}$ = —(AA$_1$)—NHC(=O)—(AA$_2$)—

$A_{15}$ = —(AA$_1$)—C(=O)O—(AA$_2$)—

$A_{16}$ = —(AA$_1$)—OC(=O)—(AA$_2$)—

$A_{17}$ = —(AA$_1$)—$SO_2$—(AA$_2$)—

$A_{18}$ = —(AA$_1$)—$SO_2NH$—(AA$_2$)—

$A_{19}$ = —(AA$_1$)—$NHSO_2$—(AA$_2$)—

$A_{20}$ = —(AA$_1$)—C(=O)—(AA$_2$)—

$A_{21}$ = —(AA$_1$)—C(=O)NH—(AA$_2$)—

$A_{22}$ = —(AA$_1$)—NHC(=O)—(AA$_2$)—

$A_{23}$ = —(AA$_1$)—S(=O)—(AA$_2$)—

$A_{24}$ = —(AA$_1$)—NHC(=O)NH—(AA$_2$)—

$A_{25}$ = —(AA$_1$)—OC(=O)NH—(AA$_2$)—

$A_{26}$ = —(AA$_1$)—NHC(=O)O—(AA$_2$)—

$A_{27}$ = —(AA$_1$)—$CONHSO_2$—(AA$_2$)—

$A_{28}$ = —(AA$_1$)—CONHCO—(AA$_2$)—

$A_{29}$ = —(AA$_1$)—$SO_2NHCO$—(AA$_2$)—

$A_{30}$ = —(AA$_1$)—$SO_2NHSO_2$—(AA$_2$)—

In the formulae above, $AA_1$, and $AA_2$ each represents a divalent linking group. The linking group preferably comprises an atom or atomic group containing at least one of a carbon atom, a nitrogen atom, a sulfur atom and an oxygen atom. The linking group is preferably a divalent linking group having from 1 to 20 carbon atoms comprising an alkylene group (e.g., methylene, ethylene, propylene, butylene, pentylene) an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonic acid ester group, a ureido group, a sulfonyl group, a sulfinyl group, a thioether group, an ether group, a carbonyl group, —N(Ra)— (wherein Ra represents a hydrogen atom, a substituted or unsubstituted alkyl group or a substituted or unsubstituted aryl group) or a heterocyclic divalent group (e.g., 6-chloro-1,3,5-trizin-2,4-diyl, pyrimidin-2,4-diyl, quinoxalin-2,3-diyl) individually or in combination of two or more thereof, more preferably a divalent linking group having from 1 to 10 carbon atoms comprising an alkylene group having from 1 to 4 carbon atoms (e.g., methylene, ethylene, propylene, butylene), an arylene group having from 6 to 10 carbon atoms (e.g., phenylene, naphthylene), an alkenylene group having from 1 to 4 carbon atoms (e.g., ethenylene, propenylene) or an alkynylene group having from 1 to 4 carbon atoms (e.g., ethynylene, propynylene) individually or in combination of two or more thereof.

Ya represents a sulfur atom, a nitrogen atom (which may be substituted) or a selenium atom, preferably a sulfur atom or a nitrogen atom, more preferably a sulfur atom.

Of the linking groups $A_{11}$ to $A_{30}$, preferred are $A_{21}$ and $A_{22}$, more preferred is $A_{21}$. $A_{21}$ is preferably $A_1$ described above.

In $A_1$, La and Lb each is an unsubstituted methylene group or a substituted methylene group (for example, a methylene group substituted by V above, more specifically, a methyl group-substituted methylene group, an ethyl group-substituted methylene group, a phenyl group-substituted methylene group, a hydroxy group-substituted methylene group or a halogen atom (e.g., chlorine, bromine)-substituted methylene group), preferably an unsubstituted methylene group.

$k_1$ is preferably 1, 2, 3 or 4, more preferably 1 or 2, still more preferably 1. $k_2$ is preferably 1, 2, 3 or 4, more preferably 1 or 2, still more preferably 1. When $k_1$ and $k_2$ each is 2 or more, the methylene group is repeated but the repeated methylene groups may not be the same.

In formula (I), the logP value of —A—$CO_2$— is preferably hydrophilic as described in JP-A-5-13290 (the term "JP-A" as used herein means an "unexamined published Japanese patent publication"), pages 4 and 5, because the residual color after the processing is reduced.

The compound represented by formula (I) is more preferably a compound represented by the following formula (II), (III) or (IV).

(II)

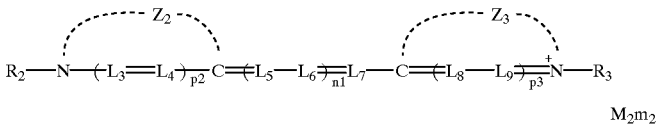

wherein $L_3$, $L_4$, $L_5$, $L_6$, $L_7$, $L_8$ and $L_9$ each represents a methine group, $p_2$ and $p_3$ each represents 0 or 1, $n_1$ represents 0, 1, 2 or 3, $Z_2$ and $Z_3$ each represents an atomic group necessary for forming a 5- or 6-membered nitrogen-containing heterocyclic ring, provided that the heterocyclic ring may be condensed with an aromatic ring, $M_2$ represents a charge balancing counter ion, $m_2$ represents a number of from 0 to 4 necessary for neutralizing the molecular charge, $R_2$ and $R_3$ each represents an alkyl group, provided that at least one of $R_2$ and $R_3$ is an alkyl group represented by $R_1$ shown below, for example, when $R_2$ is $R_1$, $Z_2$ is $Z_1$ and when $R_3$ is $R_1$, $Z_3$ is $Z_1$:

$$R_1{=}{-}A{-}CO_2^-$$

wherein A has the same meaning as defined in formula (I);

(III)

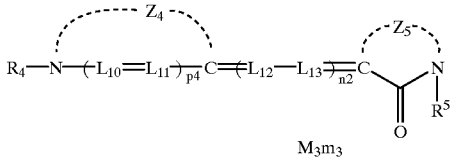

$M_3m_3$ wherein $L_{10}$, $L_{11}$, $L_{12}$ and $L_{13}$ each represents a methine group, $p_4$ represents 0 or 1, $n_2$ represents 0, 1, 2 or 3, $Z_4$ and $Z_5$ each represents an atomic group necessary for forming a 5- or 6-membered nitrogen-containing heterocyclic ring, provided that the ring in $Z_4$ may further be condensed with an aromatic ring, $M_3$ represents a charge balancing counter ion, $m_3$ represents a number of from 0 to 4 necessary for neutralizing the molecular charge, $R_4$ is the same as $R_1$, and $R_5$ represents an alkyl group, an aryl group or a heterocyclic group;

carbon atoms, more preferably from 1 to 4 carbon atoms {for example, a heterocyclic group substituted by V which is described above as a substituent of $Z_1$ and the like, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy) ethyl), an alkoxycarbonylalkyl group (e.g., ethoxycarbonyl methyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholino carbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxy ethoxyethyl), a sulfoalkenyl group, a group represented by $R_1$ of the present invention, a sulfatoalkyl group (e.g., 2-sulfatoethyl, 3-sulfatoproyl, 4-sulfatobutyl), a heterocyclic substituted alkyl group (e.g., 2-(pyrrolidin-2-on-1-yl)ethyl, tetrahydrofurfuryl) and an alkylsulfonylcarbamoylmethyl group (e.g., methanesulfonylcarbamoylmethyl)}.

Of these, the alkyl group represented by $R_2$, $R_3$, $R_4$, $R_6$ or $R_8$ is preferably a carboxyalkyl group, a sulfoalkyl group, an unsubstituted alkyl group or $R_1$ of the present invention, more preferably a sulfoalkyl group or $R_1$.

$Z_5$ represents an atomic group necessary for forming an acidic nucleus and an acidic nucleus of any general mero- (IV)

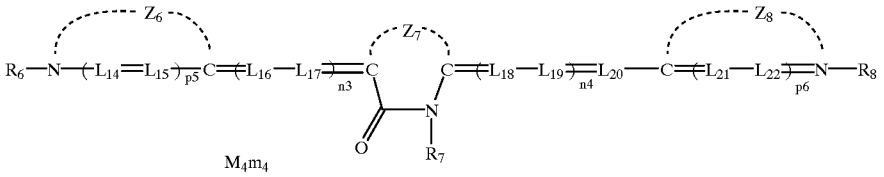

$M_4m_4$ wherein $L_{14}$, $L_{15}$, $L_{16}$, $L_{17}$, $L_{18}$, $L_{19}$, $L_{20}$, $L_{21}$ and $L_{22}$ each represents a methine group, $p_5$ and $p_6$ each represents 0 or 1, $n_3$ and $n_4$ each represents 0, 1, 2 or 3, $Z_6$, $Z_7$ and $Z_8$ each represents an atomic group necessary for forming a 5- or 6-membered nitrogen-containing heterocyclic ring, provided that $Z_6$ or $Z_8$ may be condensed with an aromatic ring, $M_4$ represents a charge balancing counter ion, $m_4$ represents a number of from 0 to 4 necessary for neutralizing the molecular charge, $R_6$ and $R_8$ each represents an alkyl group, and $R_7$ represents an alkyl group, an aryl group or a heterocyclic group, provided that at least one of $R_6$ and $R_8$ is an alkyl group represented by $R_1$ above, for example, when $R_6$ is $R_1$, $Z_6$ is $Z_1$ and when $R_8$ is $R_1$, $Z_8$ is $Z_1$.

Among formulae (II), (III) and (IV), preferred is formula (II).

In formulae (II), (III) and (IV), $Z_2$, $Z_3$, $Z_4$, $Z_6$ and $Z_8$ have the same meaning as $Z_1$ and preferred ranges thereof are also the same.

$R_2$, $R_3$, $R_4$, $R_6$ and $R_8$ each represents an alkyl group and examples thereof include an unsubstituted alkyl group having from 1 to 18 carbon atoms, preferably from 1 to 7 carbon atoms, more preferably from 1 to 4 carbon atoms (e.g., methyl, ethyl, propyl, isopropyl, butyl, isobutyl, hexyl, octyl, dodecyl, octadcyl) and a substituted alkyl group having from 1 to 18 carbon atoms, preferably from 1 to 7 cyanine dye may be formed. The term "acidic nucleus" as used herein means an acidic nucleus defined, for example, in James (compiler), *The Theory of the Photographic Process,* 4th ed., page 198, Macmillan (1977). Specific examples thereof include those described in U.S. Pat. Nos. 3,567,719, 3,575,869, 3,804,634, 3,837,862, 4,002,480 and 4,925,777 and JP-A-3-167546.

In the case where an acidic nucleus forms a 5- or 6-membered nitrogen-containing heterocyclic ring comprising a carbon atom, a nitrogen atom and a chalcogen atom (typically, oxygen, sulfur, selenium and tellurium), preferred examples of the nucleus include nuclei such as 2-pyrazolin-5-one, pyrazolidin-3,5-dione, imidazolin-5-one, hydantoin, 2- or 4-thiohydantoin, 2-iminooxazolidin-4-one, 2-oxazolin-5-one, 2-thiooxazoline, 2,4-dione, isooxazolin-5-one, 2-thiazolin-4-one, thiazolidin-4-one, thiazolidin-2,4-dione, rhodanine, thiazolidine-2,4-dithione, isorhodanine, indan-1, 3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a] pyrimidine, cyclohexan-1,3-dione, 3,4-dihydroisoquinolin-4-one, 1,3-dioxan-4,6-dione, barbituric acid, 2-thiobarbituric acid, chroman-2,4-dione, indazolin-2-one, pyrido[1,2-a]pyrimidin-1,3-dione, pyrazolo[1,5-b] quinazolone, pyrazolo[1,5-a]benzimidazole, pyrazolopyridone, 1,2,3,4-tetrahydroquinolin-2,4-dione, 3-oxo-2,3-dihydrobenzo[d]thiophene-1,1-dioxide and 3-dicyanomethine-2,3-dihydrobenzo[d]thiophene-1,1-dioxide.

$Z_5$ is preferably hydantoin, 2- or 4-thiohydantoin, 2-oxazolin-5-one, 2-thiooxazolin-2,4-dione, thiazolidin-2,4-dione, rhodanine, thiazolidin-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid, still more preferably 2- or 4-thiohydantoin, 2-oxazolin-5-one or rhodanine.

The 5- or 6-membered nitrogen-containing heterocyclic ring formed by $Z_7$ is a heterocyclic ring resulting from excluding an oxo group or thioxo group from the heterocyclic ring represented by $Z_5$, preferably a heterocyclic ring resulting from excluding an oxo group or thioxo group from hydantoin, 2- or 4-thiohydantoin, 2-oxazolin-5-one, 2-thiooxazolin-2,4-dione, thiazolidin-2,4-dione, rhodanine, thiazolidine-2,4-dithione, barbituric acid or 2-thiobarbituric acid, more preferably a heterocyclic ring resulting from excluding an oxo group or thioxo group from hydantoin, 2- or 4-thiohydantoin, 2-oxazolin-5-one, rhodanine, barbituric acid or 2-thiobarbituric acid, still more preferably a heterocyclic ring resulting from excluding an oxo group or thioxo group from 2- or 4-thiohydantoin, 2-oxazolin-5-one or rhodanine.

The alkyl group represented by $R_5$ or $R_7$ includes the unsubstituted alkyl group, substituted alkyl group and $R_1$ described above for $R_2$ and the like and preferred range thereof is also the same. Other examples include an unsubstituted aryl group having from 6 to 20 carbon atoms, preferably from 6 to 10 carbon atoms, more preferably from 6 to 8 carbon atoms (e.g., phenyl, 1-naphthyl), a substituted aryl group having from 6 to 20 carbon atoms, preferably from 6 to 10 carbon atoms, more preferably from 6 to 8 carbon atoms (for example, an aryl group substituted by V described above as the substituent of $Z_1$ and the like, more specifically, p-methoxyphenyl, p-methylphenyl and p-chlorophenyl), an unsubstituted heterocyclic group having from 1 to 20 carbon atoms, preferably from 3 to 10 carbon atoms, more preferably from 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl) and a substituted heterocyclic group having from 1 to 20 carbon atoms, preferably from 3 to 10 carbon atoms, more preferably from 4 to 8 carbon atoms (for example, a heterocyclic group substituted by V described above as the substituent of $Z_1$ and the like, more specifically, 5-methyl-2-thienyl and 4-methoxy-2-pyridyl).

$R_5$ and $R_7$ each is preferably methyl, ethyl, 2-sulfoethyl, 3-sulfopropyl, 3-sulfobutyl, 4-sulfobutyl, carboxymethyl, phenyl, 2-pyridyl or 2-thiazolyl, more preferably ethyl, 2-sulfoethyl, carboxymethyl, phenyl or 2-pyridyl.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$ and $L_{22}$ each independently represents a methine group. The methine group represented by $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$ or $L_{22}$ may have a substituent and examples of the substituent include a substituted or unsubstituted alkyl group having from 1 to 15 carbon atoms, preferably from 1 to 10 carbon atoms, more preferably from 1 to 5 carbon atoms (e.g., methyl, ethyl, 2-carboxyethyl), a substituted or unsubstituted aryl group having from 6 to 20 carbon atoms, preferably from 6 to 15 carbon atoms, more preferably from 6 to 10 carbon atoms (e.g., phenyl, o-carboxyphenyl), a substituted or unsubstituted heterocyclic group having from 3 to 20 carbon atoms, preferably from 4 to 15 carbon atoms, more preferably from 6 to 10 carbon atoms (e.g., N,N-diethylbarbituric acid), a halogen atom (e.g., chlorine, bromine, fluorine, iodine), an alkoxy group having from 1 to 15 carbon atoms, preferably from 1 to 10 carbon atoms, more preferably from 1 to 5 carbon atoms (e.g., methoxy, ethoxy), an alkylthio group having from 1 to 15 carbon atoms, preferably from 1 to 10 carbon atoms more preferably from 1 to 5 carbon atoms (e.g., methylthio, ethylthio), an arylthio group having from 6 to 20 carbon atoms, preferably from 6 to 15 carbon atoms, more preferably from 6 to 10 carbon atoms (e.g., phenylthio) and an amino group having from 0 to 15 carbon atoms, preferably from 2 to 10 carbon atoms, more preferably from 4 to 10 carbon atoms (e.g., N,N-diphenylamino, N-methyl-N-phenylamino, N-methylpiperazino). The methine group may form a ring with another methine group or may form a ring together with $Z_2$, $Z_3$, $Z_4$, $Z_6$ or $Z_8$.

$n_1$, $n_2$ and $n_3$ each is preferably 0, 1 or 2, more preferably 0 or 1, still more preferably 1. $n_4$ is preferably 0 or 1, more preferably 0. When $n_1$, $n_2$, $n_3$ and $n_4$ each is 2 or more, the repeated methine groups may not be the same.

$M_2$, $M_3$ and $M_4$ have the same meaning as $M_1$ and $m_2$, $m_3$ and $M_4$ have the same meaning as $m_1$. The preferred ranges thereof are also the same.

$p_2$, $p_3$, $p_4$, $p_5$ and $p_6$ each independently represents 0 or 1, preferably 0.

Specific examples of the compound represented by formula (I) (including the compounds represented by formulae (II), (III) and (IV) as the lower concept) are set forth below, however, the present invention is by no means limited thereto.

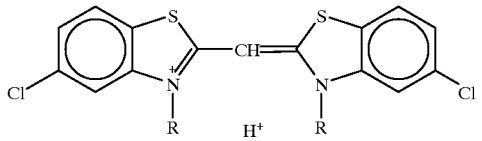

(1)

R = $-CH_2CH(OH)CH_2CO_2^-$;

(2)

R = $-(CH_2)_2S(CH_2)_3CO_2^-$;

(3)

R = $-(CH_2)_2N(CH_3)-(CH_2)_4-CO_2^-$;

(4)

R = $-CH_2CONHCH_2CO_2^-$ (5)

R = $-CH_2NHC(=O)NHCH_2CO_2^-$;

(6)

R = $-(CH_2)_2-N(CH_3)-(CH_2)_3-CO_2^-$;

(7)

R = $-CH_2CO_2-(CH_2)_3-CO_2^-$;

(8)

R = $-CH_2CONHSO_2-(CH_2)_3-CO_2^-$;

-continued (9)

R = $-CH_2C(=O)(CH_2)_2-CO_2^-$;

(10)

R = $-(CH_2)_2-S(=O)-(CH_2)_3CO_2^-$;

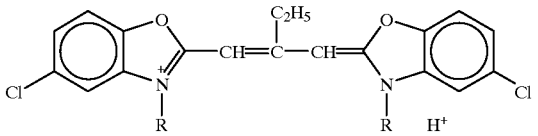

(11)

R = $CH_2CH(OH)CH_2CO_2^-$;

(12)

R = $(CH_2)_2S-(CH_2)_3CO_2^-$;

(13)

R = $(CH_2)_2C(=O)-(CH_2)_3-CO_2^-$;

(14)

R = $(CH_2)_3Se-(CH_2)_2-CO_2^-$;

(15)

R = $CH_2CONHCH_2CO_2^-$;

(16)

R = $-(CH_2)_2-SO_2NH(CH_2)_2-CO_2^-$;

(17)

R = $-(CH_2)_2CO(=O)(CH_2)_2-CO_2^-$;

(18)

R = $-(CH_2)_2CH(OH)(CH_2)_3-CO_2^-$;

(19)

R = $-(CH_2)_2-CH(OH)-(CH_2)_4-CO_2^-$;

(20)

R = $-(CH_2)_2-OC(=O)-(CH_2)_2-CO_2^-$;

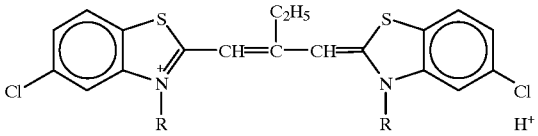

(21)

R = $CH_2CH(OH)CH_2CO_2^-$;

(22)

R = $CH_2CONHCH_2CO_2^-$;

(23)

R = $(CH_2)_2C(=O)-(CH_2)_3-CO_2^-$;

(24)

R = $(CH_2)_3S-(CH_2)_2-CO_2^-$;

-continued (25)

R = $-(CH_2)_2-CONH(CH_2)_3-CO_2^-$;

(26)

R = $-(CH_2)_2-SO_2NH(CH_2)_2-CO_2^-$;

(27)

R = $-(CH_2)_2CO(=O)(CH_2)_2-CO_2^-$;

(28)

R = $-(CH_2)_2-CH(OH)-(CH_2)_3-CO_2^-$;

(29)

R = $CH_2CONH(CH_2)_2CO_2^-$;

(30)

R = $-(CH_2)_2-OC(=O)-(CH_2)_2-CO_2^-$;

(31)

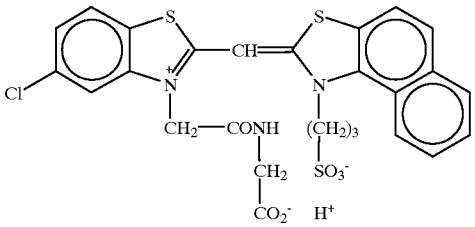

(32)

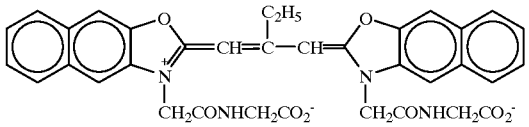

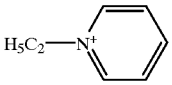

(33)

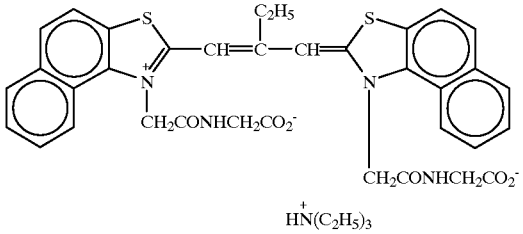

(34)

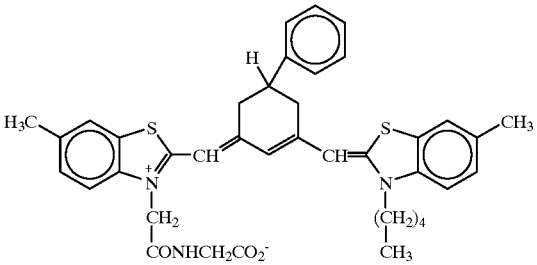

-continued (35)

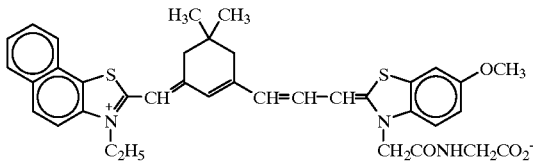

(36)

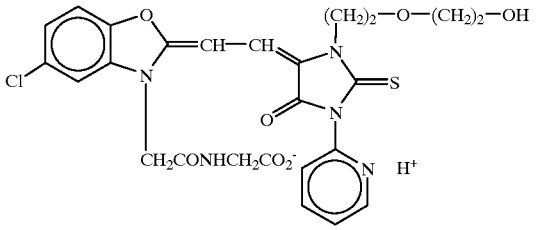

(37)

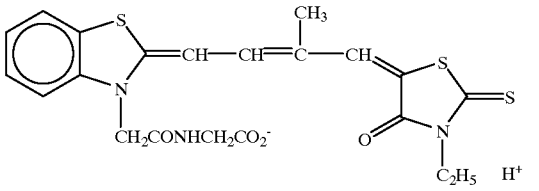

(38)

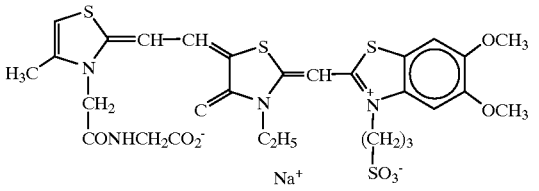

(39)

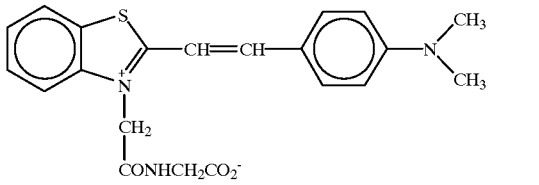

The compound represented by formula (I) (including the compounds represented by formulae (II), (III) and (IV) as the subordinate concepts) can be synthesized according to the method described in F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Para. 14, pp. 482–515, John Wiley & Sons, New York, London (1977), and *Rodd's Chemistry of Carbon compounds,* 2nd ed., Vol. IV, Part B, Chap. 15, pp. 369–422, Elsevier Science Publishing Company Inc., New York (1977).

The silver halide photographic light-sensitive material of the present invention is described in detail below.

The compound represented by formula (I) of the present invention (hereinafter referred to as the compound of the present invention) can be used in a silver halide photographic light-sensitive material, by itself or in combination with other sensitizing dyes.

The methine compound of the present invention (the same applies to other sensitizing dyes) may be added to the silver halide emulsion of the present invention in any step known to be useful during the preparation of emulsion. For example, the compound may be added during formation of silver halide grains and/or before desalting or during desalting and/or between after desalting and before initiation of chemical ripening as disclosed in U.S. Pat. Nos. 2,735,766, 3,628,960, 4,183,756 and 4,225,666, JP-A-58-184142 and JP-A-60-196749, or may be added at any time or step before coating of the emulsion such as immediately before or during chemical ripening or after chemical ripening but before coating as disclosed in JP-A-58-113920. Also, as disclosed in U.S. Pat. No. 4,225,666 and JP-A-58-7629, the same compound alone or in combination with a compound having a different structure may be added in parts, for example, a part during grain formation and the remaining during chemical ripening or after completion of the chemical ripening, or a part before or during chemical ripening and the remaining after completion of the chemical ripening, and the kind of the compounds added in parts or the combination of the compounds may be changed.

The addition amount of the methine compound of the present invention varies depending upon the shape or size of the silver halide grain but it may be from $1\times10^{-6}$ to $8\times10^{-3}$ mol per mol of silver halide. For example, in the case when the silver halide grain size is from 0.2 to 1.3 $\mu$m, the addition amount is preferably from $2\times10^{-6}$ to $3.5\times10^{-3}$ mol, more preferably from $7.5\times10^{-6}$ to $1.5\times10^{-3}$ mol, per mol of silver halide.

The methine compound of the present invention may be dispersed directly in the emulsion or may be added to the emulsion in the form of a solution after dissolving it in an appropriate solvent such as methyl alcohol, ethyl alcohol, methyl cellosolve, acetone, water, pyridine or a mixed solvent thereof. At this time, a base, an acid or additives such as a surface active agent may be present together. An ultrasonic wave may be used in the dissolution. Furthermore, the methine compound may be added by a method where the compound is dissolved in a volatile organic solvent, the solution is dispersed in a hydrophilic colloid and the dispersion is added to the emulsion as described in U.S. Pat. No. 3,469,987, a method where the compound is dispersed in a water-soluble solvent and the dispersion is added to the emulsion as described in JP-B-46-24185, a method where the methine compound is dissolved in a surface active agent and the solution is added to the emulsion as described in U.S. Pat. No. 3,822,135, a method where the compound is dissolved using a compound capable of red shifting and the solution is added to the emulsion as described in JP-A-51-74624, or a method where the methine compound is dissolved in an acid containing substantially no water and the solution is added to the emulsion as described in JP-A-50-80826. In addition, the compound may be added to the emulsion using the methods described in U.S. Pat. Nos. 2,912,343, 3,342,605, 2,996,287 and 3,429,835.

The methine compound of the present invention may also be used as a filter dye, irradiation preventive dye or antihalation dye of various types for the purpose of improving sharpness or color separation capability.

The methine compound can be incorporated into a coating solution for a silver halide photographic light-sensitive material layer, a filter layer and/or an antihalation layer by a usual method. The use amount of the dye may be enough if it can color the photographic layer and one skilled in the art may easily select the amount appropriately depending upon the end use. In general, the dye is preferably used so that the optical density can fall within the range of from 0.05 to 3.0.

The dye may be added at any step before the coating.

A polymer having a charge opposite to the dye ion may be allowed to be present together as a mordant in a layer so as to localize the dye in a specific layer using the interaction of the polymer with the dye molecule.

Examples of the polymer mordant include those described in U.S. Pat. Nos. 2,548,564, 4,124,386, 3,625,694, 3,958,995, 4,168,976 and 3,445,231.

Examples of the supersensitizer useful in the spectral sensitization for use in the present invention include pyrimidylamino compounds, triazinylamino compounds and azolium compounds described in U.S. Pat. Nos. 3,511,664, 3,615,613, 3,615,632, 3,615,641, 4,596,767, 4,945,038, 4,965,182 and 4,965,182, and with respect to the use method thereof, the methods described in these patents are also preferred.

The silver halide which can be used in the silver halide light-sensitive material of the present invention may be any of silver bromide, silver iodobromide, silver iodochlorobromide and silver chlorobromide. The silver halide is preferably silver bromide, silver chlorobromide, silver iodochlorobromide or high silver chloride described in JP-A-2-42.

The constitution and processing of the light-sensitive material are described below, however, the constitution and processing described in JP-A-2-42 are preferably used particularly in the case of high silver chloride.

The constitution and processing described in JP-A-63-264743 are preferably used particularly in the case of silver chlorobromide.

The silver halide grain may comprise phases different between the inside and the surface layer or may comprise a homogeneous phase. Furthermore, a grain where a latent image is mainly formed on the surface (for example, a negative light-sensitive material), a grain where a latent image is mainly formed in the inside of the grain (for example, an internal latent image-type light-sensitive material) or a previously fogged grain (for example, a direct positive light-sensitive material) may be used.

The silver halide grain having various halogen compositions, crystal habits, grain inner structures, shapes or distributions described above are used in the light-sensitive photographic materials (elements) for various use purposes.

The silver halide grain in the photographic light-sensitive material may have a regular crystal form such as cubic, tetradecahedral or rhombic decahedral form, an irregular crystal form such as spherical or tabular form, or a composite form of these crystal forms. A mixture of grains having various crystal forms may also be used.

In the photographic light-sensitive material of the present invention, the silver halide grain forming the emulsion layer preferably has an aspect ratio of from 3 to 100. The term "the aspect ratio is from 3 to 100" as used herein means that silver halide grains having an aspect ratio (circle-corresponding diameter of a silver halide grain/thickness of a grain) of from 3 to 100 occupy 50% or more of the projected area of all silver halide grains in the emulsion. The aspect ratio is preferably from 3 to 20, most preferably from 4 to 12. The tabular grain can be easily prepared by the methods described in Gutoff, *Photographic Science and Engineering,* Vol. 14, pp. 248–257 (1970), U.S. Pat. Nos. 4,434,226, 4,414,310, 4,433,048 and 4,439,520 and British Patent 2,112,157.

In the photographic light-sensitive material of the present invention, the population of such a grain is 70% or more, preferably 85% or more.

The methine compound of the present invention is used in the light-sensitive materials for the uses described later, as a sensitizer, a sensitizing dye or a filter or for the purpose of antihalation or irradiation prevention. The dye may be added to a desired layer such as an interlayer, a protective layer or a back layer other than the light-sensitive emulsion layer.

The methine compound of the present invention may be used in various color or black-and-white silver halide photographic light-sensitive materials.

More specifically, the compound may be used in a color positive light-sensitive material, a light-sensitive material for color paper, a color negative light-sensitive material, a color reversal light-sensitive material (which may or may not contain a coupler), a direct positive silver halide photographic light-sensitive material, a photographic light-sensitive material for photomechanical process (for example, lith. film, lith. dup. film), a light-sensitive material for cathode-ray tube display, a light-sensitive material for X-ray recording (in particular, direct or indirect photographing material using a screen), a light-sensitive material for use in the silver salt diffusion transfer process, a light-sensitive material for use in the color diffusion transfer process, a light-sensitive material for use in the dye transfer process (imbibition process), a light-sensitive material for use in the silver dye bleaching process or a heat developable light-sensitive material.

The silver halide photographic emulsion for use in the present invention may be prepared using the methods described in P. Glafkides, *Chemie et PhisiQue Photographigue,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

At the formation of silver halide grains, a silver halide solvent such as ammonia, potassium thiocyanate, ammonium thiocyanate, a thioether compound (for example, those described in U.S. Pat. Nos. 3,271,157, 3,574,628, 3,704,130, 4,297,439 and 4,276,374), a thione compound (for example, those described in JP-A-53-144319, JP-A-53-82408 and JP-A-55-77737) and an amine compound (for example, those described in JP-A-54-100717), may be used so as to control the growth of grains.

In the process of formation or physical ripening of silver halide grains, a cadmium salt, a zinc salt, a thallium salt, an iridium salt or a complex salt thereof, a rhodium salt or a complex salt thereof, or an iron salt or an iron complex salt may be present together.

Examples of the internal latent image-type silver halide emulsion for use in the present invention include a conversion-type silver halide emulsion, a core/shell-type silver halide emulsion and a silver halide emulsion having incorporated therein a different kind of metal, described in U.S. Pat. Nos. 2,592,250, 3,206,313, 3,447,927, 3,761,276 and 3,935,014.

The silver halide emulsion is usually subjected to chemical sensitization. The chemical sensitization may be performed using the method described, for example, in H. Fieser (compiler), *Die Grundlagen der Photographischen Prozesse mit Silberhalogeniden,* Akademishe Verlagsgesellschaft, pp. 675–734 (1968).

More specifically, a sulfur sensitization method using a compound containing a sulfur capable of reacting with active gelatin or silver (e.g., thiosulfates, thioureas, mercapto compounds, rhodanines); a selenium sensitization method; a reduction sensitization method using a reducing material (e.g., stannous salts, amines, hydrazine derivatives, formamidine-sulfinic acids, silane compounds); and a noble metal sensitization method using a noble metal compound (e.g., gold complex salt, complex salts of a metal belonging to Group VIII of the Periodic Table, such as Pt, Ir and Pd) may be used individually or in combination.

The photographic light-sensitive material of the present invention may contain various compounds so as to prevent fogging or stabilize photographic capabilities during production, storage or photographic processing of the light-sensitive material. More specifically, a large number of compounds known as an antifoggant or a stabilizer may be added and examples thereof include thiazoles such as benzothiazolium salts described in U.S. Pat. Nos. 3,954,478 and 4,942,721 and JP-A-59-191032, an open ring form thereof described in JP-B-59-26731, nitroindazoles, triazoles, benzotriazoles and benzimidazoles (in particular, nitro- or halogen-substitution product); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; the above-described heterocyclic mercapto compounds having a water-soluble group such as a carboxyl group or a sulfone group; thioketone compounds such as oxazolinethione; azaindenes such as tetraazaindenes (in particular, 4-hydroxy-substituted (1,3,3a,7) tetraazaindenes.);benzenethiosulfonicacids;benzenesulfinic acids; and acetylene compounds described in JP-A-62-87957.

The silver halide photographic light-sensitive material of the present invention may contain a color coupler such as a cyan coupler, a magenta coupler and a yellow coupler, or a compound capable of dispersing a coupler.

More specifically, the silver halide photographic light-sensitive material of the present invention may contain a compound capable of forming a color upon oxidation coupling with an aromatic primary amine developing agent (e.g., phenylenediamine derivative, aminophenol derivative). Examples of the magenta coupler include a 5-pyrazolone coupler, a pyrazolobenzimidazole coupler, a cyanoacetylcoumarone coupler and an open-chained acylacetonitrile coupler. Examples of the yellow coupler include an acylacetamide coupler (e.g., benzoylacetanilides, pivaloylacetanilides). Examples of the cyan coupler include a naphthol coupler and a phenol coupler. These couplers are preferably nondiffusible by having a hydrophobic group called a ballast group within the molecule. The coupler may be either 4-equivalent or 2-equivalent to the silver ion. Furthermore, the coupler may be a colored coupler having a color correction effect or a coupler which releases a development inhibitor at the development (so-called DIR coupler).

Other than the DIR coupler, a non-coloring DIR coupling compound which yields a colorless product upon coupling reaction and releases a development inhibitor may also be incorporated.

The photographic light-sensitive material of the present invention may contain a polyalkylene oxide or a derivative thereof such as ether, ester or amine, a thioether compound, a thiomorpholine, a quaternary ammonium salt compound, a urethane derivative, a urea derivative, an imidazole derivative or a 3-pyrazolidone, so as to increase the sensitivity, intensify the contrast or accelerate the development.

The silver halide light-sensitive material of the present invention may contain various dyes other than the methine compound of the present invention, as a filter dye or for other various purposes such as prevention of irradiation.

Examples of the dye include oxonol dyes having a pyrazolone nucleus or a barbituric acid nucleus described in British Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-A-43-13168, JP-A-62-273527, U.S. Pat. Nos. 3,247,127, 3,469,985 and 4,078,933, other oxonol dyes described in U.S. Pat. Nos. 2,533,472 and 3,379,533, British Patent 1,278,621, JP-A-1-134447 and JP-A-1-183652, azo dyes described in British Patents 575,691, 680,631, 599,623, 786,907, 907,125 and 1,045,609, U.S. Pat. No. 4,255,326 and JP-B-59-211043, azomethine dyes described in JP-A-50-100116, JP-A-54-118247 and British Patents 2,014,598 and 750,031, anthraquinone dyes described in U.S. Pat. No. 2,865,752, arylidene dyes described in U.S. Pat. Nos. 2,533,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303, styryl dyes described in JP-B-28-3082, JP-B-44-16594 and JP-B-59-28898, triarylmethane dyes described in British Patents 446,583 and 1,335,422 and JP-A-59-228250, merocyanine dyes described in British Patents 1,075,653, 1,153,341, 1,284,730, 1,475,228 and 1,542,807, and cyanine dyes described in U.S. Pat. Nos. 2,843,486 and 3,294,539 and JP-A-1-291247.

Such a dye is prevented from diffusion by the method described below.

For example, a method of letting a hydrophilic polymer having a charge opposite to the anionic dye dissociated be present together as a mordant in the layer to localize the dye in a specific layer by the interaction with the dye molecule is disclosed in U.S. Pat. Nos. 2,548,564, 4,124,386 and 3,625,694.

A method of dyeing a specific layer using a water-insoluble dye solid is disclosed in JP-A-56-12639, JP-A-55-155350, JP-A-55-155351, JP-A-63-27838, JP-A-63-197943 and European Patent 15,601.

Furthermore, a method of dyeing a specific layer using a metal salt fine particle to which a dye is adsorbed is disclosed in U.S. Pat. Nos. 2,719,088, 2,496,841 and 2,496,843 and JP-A-60-45237.

The photographic material of the present invention may contain various surface active agents as a coating aid or for various purposes such as prevention of electrostatic charge, improvement of slipperiness, emulsion dispersion, prevention of adhesion and improvement of photographic properties (for example, acceleration of development, intensification of contrast, sensitization).

In practicing the present invention, other additives are used together with a silver halide emulsion or other hydrophilic colloid, and examples thereof include a discoloration inhibitor, an inorganic or organic hardening agent, a color fogging inhibitor, an ultraviolet absorbent, a mordant, a plasticizer, a latex polymer and a matting agent. These additives are specifically described in *Research Disclosure,* Vol. 176 (1978, XI), D-1764 and the like.

The photographic light-sensitive material of the present invention uses a hydrophilic polymer such as gelatin, as a protective colloid.

The finished silver halide emulsion or the like is coated on an appropriate support such as baryta paper, resin-coated paper, synthetic paper, triacetate film, polyethylene terephthalate, other plastic base or glass plate.

The exposure for obtaining a photographic image may be performed using an ordinary method. More specifically, any of known various light sources such as natural light (sun light), tungsten lamp, fluorescent lamp, mercury lamp, xenon arc lamp, carbon arc lamp, xenon flash lamp and cathode-ray tube flying spot, may be used. With respect to the exposure time, an exposure time of from 1/1,000 sec. to 1 sec. used in a usual camera may of course be used, and also an exposure shorter than 1/1,000 sec., for example, an exposure of from $1/10^4$ to $1/10^6$ sec. using a xenon flash lamp or cathode-ray tube, or an exposure longer then 1 sec. may be used. If desired, the spectral composition of the light used in the exposure may be controlled by a color filter. A laser ray may also be used for the exposure. Furthermore, the exposure may be performed by the light emitted from a phosphor excited by an electron beam, X ray, $\gamma$ ray or $\alpha$ ray.

In the photographic processing of the light-sensitive material of the present invention, any of known methods and known processing solutions as described, for example, in *Research Disclosure,* No. 176, pp. 28–30 (RD-17643) may be used. The photographic processing may be either a photographic processing of forming a silver image (black-and-white photographic processing) or a photographic processing of forming a dye image (color photographic processing) according to the purpose. The processing temperature is usually from 18° C. to 50° C., however, a temperature lower than 18° C. or in excess of 50° C. may also be used.

A silver halide photographic light-sensitive material (hereinafter referred to as a "light-sensitive material") having a magnetic recording layer, which may be used in the present invention, is prepared in such a manner that a polyester thin layer support previously subjected to heat treatment, described in detail in JP-A-6-35118, JP-A-6-17528 and *JIII Journal of Technical Disclosure,* No. 94-6023, such as a polyethylene aromatic dicarboxylate-based polyester support, having a thickness of from 50 to 300 $\mu$m, preferably from 50 to 200 $\mu$m, more preferably from 80 to 115 $\mu$m, still more preferably from 85 to 105 $\mu$m, is subjected to heat treatment (annealing) at a temperature of from 40° C. to a glass transition temperature for from 1 to 1,500 hours, the support is then subjected to surface treatment such as ultraviolet irradiation described in JP-B-43-2603, JP-B-43-2604 and JP-B-45-3828 or corona discharging described in JP-B-48-5043 and JP-A-51-131576, undercoating described in U.S. Pat. No. 5,326,689 is applied thereto, a subbing layer described in U.S. Pat. No. 2,761,791 is provided, if desired, and ferromagnetic particles described in JP-A-59-23505, JP-A-4-195726 and JP-A-6-59357 are coated thereon.

The above-described magnetic layer may be provided like a stripe as described in JP-A-4-124642 and JP-A-4-124645.

The support may further be subjected to antistatic treatment described in JP-A-4-62543, if desired, and finally, a silver halide emulsion is coated thereon. The silver halide emulsion used here include those described in JP-A-4-166932, JP-A-3-41436 and JP-A-3-41437.

Such a light-sensitive material is preferably manufactured according to the manufacture controlling method described in JP-B-4-86817 and the manufacturing data are preferably recorded thereon according to the method described in JP-B-6-87146. After or before the recording, the light-sensitive material is cut into a film smaller in the width than a conventional 135-size film and two perforations are punched at one side per one small format picture so as to match the format picture smaller than conventional, according to the method described in JP-A-4-125560.

The thus-prepared film is loaded in a cartridge package described in JP-A-4-157459, a cartridge described in JP-A-5-210202, FIG. 9, a film patrone described in U.S. Pat. No. 4,221,479 or a cartridge described in U.S. Pat. Nos. 4,834,306, 4,834,366, 5,226,613 and 4,846,418 and then used.

The film cartridge or film patrone used herein is preferably a type such that the tongue can be housed as described in U.S. Pat. Nos. 4,848,693 and 5,317,355 in view of the light-shielding property.

Also, a cartridge having a lock mechanism described in U.S. Pat. No. 5,296,886, a cartridge capable of indicating the use state described in U.S. Pat. No. 5,347,334 or a cartridge having a function of inhibiting double exposure is preferably used.

Furthermore, a cartridge where the film can be easily loaded by merely inserting the film into the cartridge described in JP-A-6-85128 may be used.

The thus-produced film cartridge may be used for photographing and development to satisfy the purpose or for various photographic enjoyments using a camera, a developing machine or a lab. machine which will be described below.

The film cartridge (patrone) can exert its function satisfactorily when it is used with, for example, a camera in a simple loading system described in JP-A-6-8886 and JP-A-6-99908, a camera having an automatic winding-up system described i in JP-A-6-57398 and JP-A-6-101135, a camera where the film can be taken out and the kind of film can be exchanged on the way of photographing described in JP-A-6-205690, a camera capable of magnetic recording photographing information such as panorama photographing, high-vision photographing or normal photographing (capable of magnetic recording where the print aspect ratio can be selected) on the film described in JP-A-5-293138 and JP-A-5-283382, a camera having a function of inhibiting double exposure described in JP-A-6-101194 or a camera having a function of indicating the use state of film or the like described JP-A-5-150577.

The thus-photographed film may be processed in an automatic developing machine described in JP-A-6-222514 and JP-A-6-222545 and before, during or after the processing, a method of using the magnetic recording on film described in JP-A-6-95265 and JP-A-4-123054 may be used or a function of selecting the aspect ratio described in JP-A-5-19364 may be used.

At the development, in the case of cine-type development, the film is spliced according to the method described in JP-A-5-119461 and then processed.

During or after the development, the film may be subjected to attaching/detaching treatment described in JP-A-6-148805.

After the processing as above, the film information may be converted into a print through back printing or front printing on a color paper according to the method described in JP-A-2-184835, JP-A-4-186335 and JP-A-6-79968.

Furthermore, the film may be returned to the user together with the index print described in JP-A-5-11353 and JP-A-5-232594 and the cartridge for return.

The present invention is described below in greater detail by referring to the Examples, but the present invention should not be construed as being limited to these examples.

EXAMPLE 1

Synthesis of Compound (22):

Compound (22) was synthesized through the route in the following scheme 1:

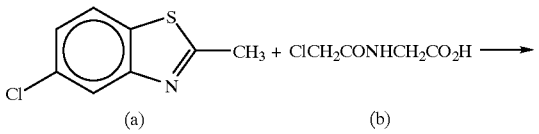

-continued

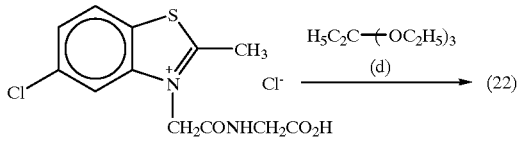

(c)

11.55 g (0.063 mol) of Compound (a) and 10 g (0.066 mol) of Compound (b) were heated at an outer temperature of 140° C. for 6 hours to obtain Compound (c) as a clayey product. Thereto, 38 ml (0.187 mol) of Compound (d), 25 ml of acetic acid, 100 ml of pyridine and 19.3 ml (0.139 mol) of triethylamine were added, and the mixture was heated at an outer temperature of 110° C. for 2 hours. The resulting reaction solution was allowed to cool, 300 ml of acetone was added thereto and the mixed solution was subjected to decantation to obtain an oily substance. To this oily substance, 100 ml of methanol and 2 ml of triethylamine were added and completely dissolved by heating and then, the mixture was spontaneously filtered. To the filtrate, 10 ml of acetic acid was added, and the mixture was allowed to cool. Crystals precipitated were separated by suction filtration and dried, as a result, 0.22 g of Compound (22) was obtained as ultraviolet powder (yield: 1.1%, λmax=560 nm, ε=85,000 (in methanol)).

EXAMPLE 2

(1) Preparation of Emulsion

To an aqueous solution (containing 1,200 ml of water, 7.0 g of gelatin and 4.5 g of KBr) containing gelatin having an average molecular weight of 15,000 kept at 30° C. and under stirring, an aqueous 1.9M $AgNO_3$ solution and an aqueous 1.9M KBr solution were added by a double jet method each at a rate of 25 ml/min over 70 seconds to obtain nuclei of tabular grains. To 400 ml of this emulsion as seed crystals, 650 ml of an aqueous inactive gelatin solution (containing 20 g of gelatin and 1.2 g of KBr) was added, and the emulsion was ripened for 40 minutes by raising the temperature to 75° C. Then, an aqueous $AgNO_3$ solution (containing 1.7 g of $AgNO_3$) was added over 1 minute and 30 seconds, subsequently, 7.0 ml of an aqueous $NH_4NO_3$ (50 wt %) solution and 7.0 ml of $NH_3$ (25 wt %) were added, and the emulsion was further ripened for 40 minutes.

The emulsion was adjusted to have a pH of 7 by $HNO_3$ (3N) and after adding 1.0 g of KBr thereto, 366.5 ml of an aqueous 1.9M $AgNO_3$ solution and an aqueous KBr solution were added, subsequently, 53.6 ml of an aqueous 1.9M $AgNO_3$ solution and an aqueous KBr (containing 33.3 mol % of KI) solution were added, and then 160.5 ml of an aqueous 1.9M $AgNO_3$ solution and an aqueous KBr solution were added while keeping the pAg at 7.9, to obtain Emulsion 1.

In Emulsion 1 obtained, the grain had a triple structure in which an intermediate shell had a region highest in the silver iodide content, the average aspect ratio was 2.8, tabular grains having an aspect ratio of 3 or more accounted for 26% of the entire projected area, the coefficient of variation in the grain size was 7% and the average grain size as a sphere-corresponding diameter was 0.98 μm.

Emulsion 1 was desalted by a usual flocculation method and after adding a sensitizing dye in the amount shown in Table 2 per mol of silver, subjected to optimal gold, sulfur and selenium sensitization in the presence of the dye.

(2) Preparation of Coated Sample

On a triacetyl cellulose film support having provided thereon an undercoat layer, an emulsion layer and a protective layer shown in Table 1 were coated to prepare Samples 101 to 112.

TABLE 1

Emulsion Coating Conditions (1) Emulsion layer

Emulsion: Emulsion 1 (the dye used is shown in Table 2)
(as silver: $2.1 \times 10^{-2}$ mol/m$^2$)
Coupler ($1.5 \times 10^{-3}$ mol/m$^2$)

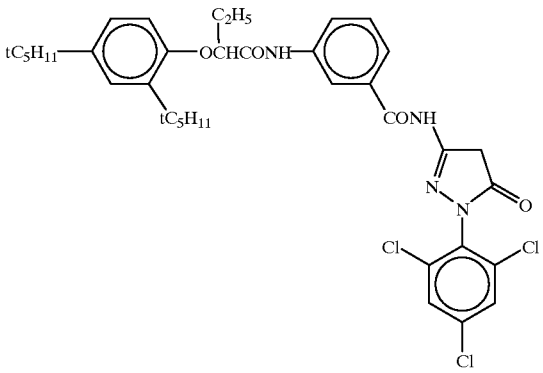

| | |
|---|---|
| Tricresyl phosphate | (1.10 g/m$^2$) |
| Gelatin | (2.30 g/m$^2$) |
| (2) Protective layer | |
| 2,4-Dichloro-6-hydroxy-s-triazine sodium salt | (0.08 g/m$^2$) |
| Gelatin | (1.80 g/m$^2$) |

These samples were subjected to exposure (1/100 sec.) for sensitometery and then to the following color development processing.

Processing Method:

| Step | Processing Time | Processing Temperature (° C.) | Replenishing Amount (ml) | Tank Volume (l) |
|---|---|---|---|---|
| Color development | 2 min 45 sec | 38 | 33 | 20 |
| Bleaching | 6 min 30 sec | 38 | 25 | 40 |
| Water washing | 2 min 10 sec | 24 | 1,200 | 20 |
| Fixing | 4 min 20 sec | 38 | 25 | 30 |
| Water washing (1) | 1 min 05 sec | 24 | countercurrent piping system from (2) to (1) | 10 |
| Water washing (2) | 1 min 00 sec | 24 | 1,200 | 10 |
| Stabilization | 1 min 05 sec | 38 | 25 | 10 |
| Drying | 4 min 20 sec | 55 | | |

Replenishing amount was per 1 m of a 35 mm-width light-sensitive material.

The composition of each processing solutio n is shown below.

| | Mother Solution (g) | Replenisher (g) |
|---|---|---|
| (Color Developer) | | |
| Diethylenetriaminepentaacetic acid | 1.0 | 1.1 |

-continued

| | Mother Solution (g) | Replenisher (g) |
|---|---|---|
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethylamino]-2-aniline sulfate | 4.5 | 5.5 |
| Water to make | 1.0 l | 1.0 l |
| pH | 10.05 | 10.05 |
| (Bleaching Solution) | | |
| Sodium ethylenediaminetetraacetato ferrate trihydrate | 100.0 | 120.0 |
| Disodium ethylenediaminetetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 l | 1.0 l |
| pH | 6.0 | 5.7 |
| (Fixing solution) | | |
| Sodium ethylenediaminetetraacetate | 0.5 | 0.7 |
| Sodium sulfite | 7.0 | 8.0 |
| Sodium bisulfite | 5.0 | 5.5 |
| Aqueous ammonium thiosulfate solution (70%) | 170.0 ml | 200.0 ml |
| Water to make | 1.0 l | 1.0 l |
| pH | 6.7 | 6.6 |

-continued

| | Mother Solution (g) | Replenisher (g) |
|---|---|---|
| (Stabilizing Solution) | | |
| Formalin (37%) | 2.0 ml | 3.0 ml |
| Polyoxyethylene-p-monononylphenyl ether (polymerization degree: 10) | 0.3 | 0.45 |
| Disodium ethylenediaminetetraacetate | 0.05 | 0.08 |
| Water to make | 1.0 l | 1.0 l |
| pH | 5.8–8.0 | 5.8–8.0 |

The processed samples each was determined on the density through a green filter and evaluated on the fresh sensitivity and fog.

The sensitivity is defined as a reciprocal of the exposure amount necessary for giving a density 0.2 higher than the fog density, and the sensitivity of each sample is shown by a relative value to the sensitivity of Sample 101 which was taken as 100. The kind of emulsions and methine compounds used in each sample and the sensitivity determined for each sample are shown in Table 2.

Separately, unexposed film samples were aged at a relative humidity of 60% and 60° C. for 7 days and thereafter exposed, developed and evaluated on the sensitivity in the same manner as above.

Furthermore, the residual color after the processing was visually observed and rated ○, Δ or × in order from lower to higher.

TABLE 2

| Sample No. | Methine Compound | Addition Amount (mol/Ag-mol) | Fresh Sensitivity | Fog | Sensitivity after Storage[1)] | Residual Color | Remarks |
|---|---|---|---|---|---|---|---|
| 101 | (S-1) | $4.0 \times 10^{-4}$ | 100 (control) | 0.27 | 47 | X | Comparison |
| 102 | (9) | " | 142 | 0.15 | 130 | Δ | Invention |
| 103 | (7) | " | 145 | 0.15 | 134 | Δ | " |
| 104 | (6) | " | 148 | 0.15 | 138 | Δ | " |
| 105 | (5) | " | 150 | 0.15 | 141 | ○ | " |
| 106 | (4) | " | 165 | 0.14 | 160 | ○ | " |
| 107 | (S-2) | " | 110 | 0.28 | 51 | X | Comparison |
| 108 | (13) | " | 145 | 0.17 | 130 | Δ | Invention |
| 109 | (17) | " | 148 | 0.16 | 134 | Δ | " |
| 110 | (11) | " | 150 | 0.16 | 137 | Δ | " |
| 111 | (16) | " | 152 | 0.16 | 140 | Δ | " |
| 112 | (15) | " | 160 | 0.16 | 155 | ○ | " |
| 113 | (S-3) | " | 108 | 0.30 | 45 | X | Comparison |
| 114 | (23) | " | 143 | 0.18 | 130 | Δ | Invention |
| 115 | (21) | " | 145 | 0.18 | 133 | Δ | " |
| 116 | (27) | " | 149 | 0.18 | 138 | Δ | " |
| 117 | (26) | " | 150 | 0.17 | 140 | Δ | " |
| 118 | (22) | " | 162 | 0.17 | 156 | ○ | " |
| 119 | (S-4) | " | 98 | 0.25 | 60 | X | Comparison |
| 120 | (37) | " | 148 | 0.18 | 140 | ○ | Invention |
| 121 | (S-5) | " | 102 | 0.26 | 61 | X | Comparison |
| 122 | (38) | " | 151 | 0.18 | 141 | ○ | Invention |

[1)] 60° C.-60%-7 days (S-1)

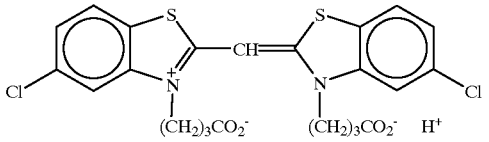

TABLE 2-continued

| Sample No. | Methine Compound | Addition Amount (mol/Ag-mol) | Fresh Sensitivity | Fog | Sensitivity after Storage[1)] | Residual Color | Remarks |
|---|---|---|---|---|---|---|---|
| (S-2) | 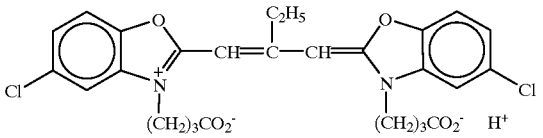 | | | | | | |
| (S-3) | 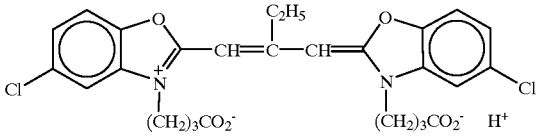 | | | | | | |
| (S-4) | 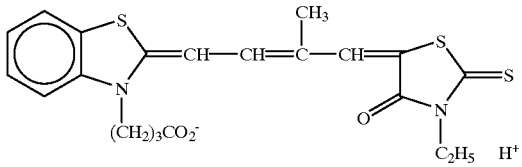 | | | | | | |
| (S-5) | 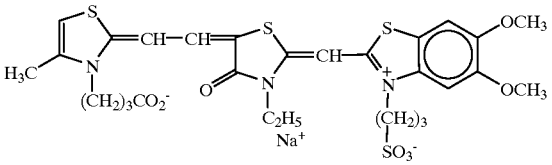 | | | | | | |

It is seen from Table 2 that the compounds of the present invention exhibited low fog, high fresh sensitivity and small reduction in the sensitivity after storage as compared with comparative compounds. Furthermore, the residual color after the processing was little observed.

EXAMPLE 3

A tabular silver iodobromide emulsion was prepared in the same manner as Emulsion D in Example 5 of JP-A-8-29904 and designated as Emulsion 2.

Multi-layer color light-sensitive materials were prepared in the same manner as Sample 101 in Example 5 of JP-A-8-29904 except for adding Emulsion 2 in place of Emulsion D in the fifth layer of Sample 101 in Example 5 of JP-A-8-29904 and adding Sensitizing Dye (S-3) or Sensitizing Dye (22) in an amount of $5.0\times10^{-4}$ mol per mol of silver halide in place of ExS-1, ExS-2 and ExS-3, and designated as Sample 301 and Sample 302.

In order to examine the sensitivity, the thus-obtained samples were exposed to light of Fuji Model FW sensitometry (manufactured by Fuji Photo Film Co., Ltd.) through an optical wedge and a red filter for 1/100 sec., color developed using the same processing steps and processing solutions as in Example 1 of JP-A-8-29904, and determined on the cyan density. The sensitivity is shown by a relative value to the sensitivity of giving a density of fog density+0.2.

As a result, Sample 302 of the present invention had a sensitivity as high as 145 relative to the sensitivity 100 (control) of Comparative Sample 301. Furthermore, the residual color after the processing was little observed.

EXAMPLE 4

Tetradecahedral silver iodobromide emulsions were prepared in the same manner as Emulsion 1 in Example 1 of JP-A-7-92601 except for adding Sensitizing Dye (S-3) or (2) in an amount of $8\times10^{-4}$ mol per mol of silver halide in place of the spectral sensitizing dye, and designated as Emulsion 401 and Emulsion 402. Further, cubic silver iodobromide emulsions were prepared in the same manner as Emulsion 1 in Example 1 of JP-A-7-92601 except for changing the silver potential during the second double jet addition from +65 mV to +115 mv and adding Sensitizing Dye (S-1) or (4) in an amount of $8\times10^{-4}$ mol per mol of silver halide in place of the spectral sensitizing dye, and designated as Emulsion 403 and Emulsion 404.

Multi-layer color light-sensitive materials were prepared in the same manner as Sample 401 in Example 4 of JP-A-7-92601 except for using Emulsion 401 or Emulsion 402 in place of Emulsion J in the fifteenth layer of Sample 401 in Example 4 of JP-A-7-92601, and designated as Sample 411 and Sample 412. In the same manner, Samples 413 and 414 were prepared by replacing Emulsion J in the fifteenth layer in Example 4 of JP-A-7-92601 by Emulsion 413 and Emulsion 414, respectively.

The thus-obtained samples were evaluated on the sensitivity. These samples each was subjected to 1/50 sec. exposure, color reversal development and determination of yellow density in the same manner as in Example 4 of JP-A-7-92601. The sensitivity is defined as a reciprocal of the exposure amount necessary for giving a density of (minimum density obtained upon exposure in a sufficient amount)+0.2 and shown by a relative value to the sensitivity of Comparative Sample 411 which was taken as 100. As a result, Sample 412 of the present invention had a sensitivity as high as 151. In the same manner, assuming that the sensitivity of Comparative Sample 413 was 100, Sample 414 of the present invention had a sensitivity as high as 144. Samples 412 and 414 were reduced in the residual color as compared with Comparative Samples.

EXAMPLE 5

An octahedral silver bromide internal latent image-type directive positive emulsion and a hexagonal tabular silver bromide internal latent image-type direct positive emulsion were prepared in the same manner as Emulsion 1 and Emulsion 5 in Example 1 of JP-A-5-313297, respectively, and designated as Emulsion 501 and Emulsion 502.

Color diffusion transfer photographic films were prepared in the same manner as Sample 101 in Example 1 of JP-A-5-313297 except for adding Emulsion 501 and Sensitizing Dye (S-2) or (15) in place of Emulsion 2 and Sensitizing Dye (2) in the eleventh layer of Sample 101 in Example 1 of JP-A-5-313297, and designated as Sample 511 and Sample 512. In the same manner, Samples 513 and 514 were prepared by adding Emulsion 502 and Sensitizing Dye (S-2) or (15) in place of Emulsion 2 and Sensitizing Dye (2) in the eleventh layer of Sample 101 in Example 1 of JP-A-5-313297. Sensitizing Dyes (S-2) and (15) each was added in an amount of $9\times10^{-4}$ mol per mol of silver halide.

In order to examine the sensitivity, the thus-obtained samples each was processed using the same processing steps and processing solutions as in Example 1 of JP-A-5-313297, and determined on the transfer density using a color densitometer. The sensitivity is shown by a relative value of the sensitivity of giving a density of 1.0. Assuming that the sensitivity of Comparative Sample 511 was 100, Sample 512 of the present invention had a sensitivity as high as 141 and assuming that the sensitivity of Comparative sample of 513 was 100, Sample 514 of the present invention had a sensitivity as high as 138.

EXAMPLE 6

Silver chlorobromide emulsions were prepared in the same manner as Emulsion F in Example 2 of JP-A-4-142536 except for not adding Red-Sensitive Sensitizing Agent (S-1) before sulfur sensitization, using chloroauric acid in combination to effect optimal gold-sulfur sensitization additionally to sulfur sensitization with triethylthiourea, and adding Sensitizing Dye (S-1) (comparative dye in the present invention) or Sensitizing Dye (4) in an amount of $2\times10^{-4}$ mol per mol of silver halide after the gold-sulfur sensitization, and the emulsions prepared were designated as Emulsion 601 and Emulsion 601.

Multi-layer color printing papers were prepared in the same manner as Sample 20 in Example 1 of JP-A-6-347944 except for using Emulsion 601 or Emulsion 602 in place of the emulsion in the first layer of Sample 20 in Example 1 of JP-A-6-347944, and designated as Sample 611 and Sample 612.

In order to examine the sensitivity, the thus-obtained samples were exposed to light of Fuji Model FW Sensitometry (manufactured by Fuji Photo Film Co., Ltd.) through an optical wedge and a blue filter for 1/100 sec., and color developed using the same processing steps and processing solutions as in Example 1 of JP-A-6-347944. Assuming that the sensitivity of Comparative Sample 611 was 100, Sample 612 of the present invention had a sensitivity as high as 133. Furthermore, the residual color was little observed.

EXAMPLE 7

Tabular silver chloride emulsions were prepared in the same manner as Emulsion A in Example 1 of JP-A-8-122954 except that the chemical sensitization was performed by adding Sensitizing Dye (S-2) or (15) in an amount of $2\times10^{-4}$ mol per mol of silver halide in place of Sensitizing Dyes 1 and 2 in Chemical Sensitization (B) in Example 1 of JP-A-8-122954, and designated as Emulsion 701 and Emulsion 702.

Coated samples were prepared by coating an emulsion layer and a surface protective layer in combination by the co-extrusion method on the both surfaces of a support in the same manner as in Example 1 of JP-A-8-122954 except for using Emulsion 701 or Emulsion 702 in place of the emulsion in Example 1 of JP-A-8-122954, and designated as Sample 711 and 712. The coated silver amount per one surface was 1.75 g/m$^2$.

In order to examine the sensitivity, the thus-obtained samples each was subjected to exposure from both sides for 0.05 sec. using an X-ray orth screen HGM manufactured by Fuji Photo Film Co., Ltd., and then processed using the same automatic developing machine and processing solutions as in Example 1 of JP-A-8-122954. The sensitivity is obtained as a logarithm of a reciprocal of the exposure amount necessary for giving a density of fog+0.1 and shown by a relative value to the sensitivity of Sample 711 which was taken as 100. As a result, Sample 712 of the present invention had a sensitivity as high as 135. Furthermore, the residual color was little observed.

The same results were also obtained even when exposure was performed by using HR-4 or HGH in place of X-ray ortho screen HGM used above at the exposure.

EXAMPLE 8

A tabular silver chloride emulsion was prepared in the same manner as Emulsion D in Example 2 of JP-A-8-227117 except for not adding Sensitizing Dyes 2 and 3, and designated as Emulsion 801.

Coated samples were prepared in the same manner as Coated Sample F in Example 3 of JP-A-8-227117 except for adding Emulsion 801 and Sensitizing Dye (S-2) or (15) in place of Emulsion F and Sensitizing Dye 1 of Coated Sample F in Example 3 of JP-A-8-227117, and designated as Sample 811 and Sample 812. Sensitizing Dyes (S-2) and (15) used each was added in an amount of $5\times10^{-4}$ mol per mol of silver halide.

In order to examine the sensitivity, the thus-obtained samples were exposed to light of Fuji Model FW Sensitometry (manufactured by Fuji Photo Film Co., Ltd.) through an optical wedge and a green filter for 1/100 sec., subjected to Fuji Photo Film CN16 processing, and compared on the photographic properties.

The sensitivity was obtained as a logarithm of a reciprocal of the exposure amount necessary for giving a density of fog+0.2 and is shown by a relative value to the sensitivity of Sample 811 which was taken as 100. Sample 812 of the present invention had a sensitivity as high as 135. Furthermore, the residual color was little observed.

EXAMPLE 9

An octahedral silver chloride emulsion was prepared in the same manner as Emulsion F in Example 3 of JP-A-8-227117 and designated as Emulsion 901.

Coated samples were prepared in the same manner as Coated Sample F in Example 3 of JP-A-8-227117 except for adding Emulsion 901 and Sensitizing Dye (S-2) or (15) in place of Emulsion F and Sensitizing Dye 1 of Coated Sample F in Example 3 of JP-A-8-227117, and designated as Sample 911 and Sample 912. Sensitizing dyes (S-2) and (15) each was added in an amount of $5\times10^{-4}$ mol per mol of silver halide.

In order to examine the sensitivity, the thus-obtained samples were exposed to light of Fuji Model FW Sensitometry (manufactured by Fuji Photo Film Co., Ltd.) through an optical wedge and a green filter for 1/100 sec., subjected to Fuji Photo Film CN16 processing, and compared on the photographic properties. The sensitivity was obtained as a logarithm of a reciprocal of the exposure amount necessary for giving a density of fog+0.2 and shown by a relative value to the sensitivity of Sample 911 which was taken as 100. Sample 911 of the present invention had a sensitivity as high as 148. Furthermore, the residual color was little observed.

EXAMPLE 10

A silver iodobromide emulsion was prepared in the same manner as Emulsion E in Example 1 of JP-A-7-159950 and designated as Emulsion 10.

Multi-layer color light-sensitive materials were prepared in the same manner as Sample 101 in Example 1 of JP-A-7-159950 except for using Emulsion 10 in place of Emulsion E in the tenth layer of Sample 101 in Example 1 of JP-A-7-159950 and adding Sensitizing Dye (S-2) or (15) in an amount of $9.8\times10^{-4}$ mol per mol of silver halide in place of ExS-3, and designated as Sample 1001 and Sample 1002.

In order to examine the sensitivity, the thus-obtained samples were exposed to light of Fuji Model FW Sensitometry (manufactured by Fuji Photo Film Co., Ltd.) through an optical wedge and a green filter for 1/100 sec., color developed using the same processing steps and processing solutions as in Example 1 of JP-A-7-159950, and determined on the magenta density.

The sensitivity was shown by a relative value of the sensitivity of giving fog+0.2. Assuming that the sensitivity of Comparative Sample 1001 was 100 (control), Sample 1002 of the present invention had a sensitivity as high as 145. Furthermore, the residual color was little observed.

According to the present invention, a silver halide photographic light-sensitive material reduced in the residual color and having high image quality and excellent storability can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one silver halide emulsion layer comprising at least one compound represented by the following formula (I):

(I)

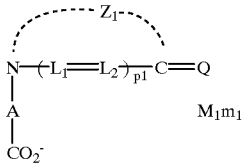

wherein A represents the following $A_{11}$ to $A_{16}$ and $A_{18}$ to $A_{30}$; $Z_1$ represents an atomic group necessary for forming a 5- or 6-membered nitrogen-containing heterocyclic ring, provided that the ring may further be condensed with an aromatic ring; $L_1$ and $L_2$ each represents a methine group; $p_1$ represents 0 or 1; $M_1$ represents a charge balancing counter ion; $m_1$ represents a number of from 0 to 10 necessary for neutralizing the charge of the molecule; and Q represents a group necessary for forming a methine group,

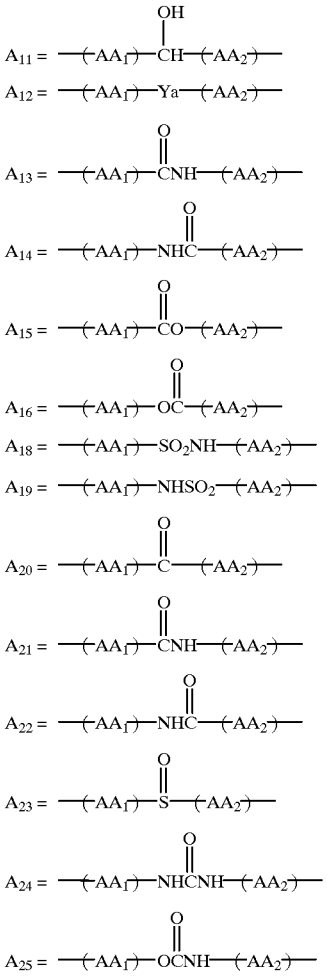

-continued $A_{26}$ = —(AA$_1$)—NH—C(=O)—(AA$_2$)—

$A_{27}$ = —(AA$_1$)—CONHSO$_2$—(AA$_2$)—

$A_{28}$ = —(AA$_1$)—CONHCO—(AA$_2$)—

$A_{29}$ = —(AA$_1$)—SO$_2$NHCO—(AA$_2$)—

$A_{30}$ = —(AA$_1$)—SO$_2$NHSO$_2$—(AA$_2$)— wherein $AA_1$ and $AA_2$ each represents a divalent linking group; and Ya represents a sulfur atom, which may be substituted, or a selenium atom.

2. The silver halide photographic light-sensitive material as claimed in claim 1, wherein A in formula (I) is represented by $A_1$, provided that the compound represented by formula (I) is not a trinuclear merocyanine:

$A_1$ = —(La)$_{k1}$—CONH—(Lb)$_{k2}$— wherein La and Lb each represents a methylene group and $k_1$ and $k_2$ each represents an integer of from 0 to 10.

3. The silver halide photographic light-sensitive material as claimed in claim 1, wherein the compound represented by formula (I) is represented by formula (II), (III) or (IV):

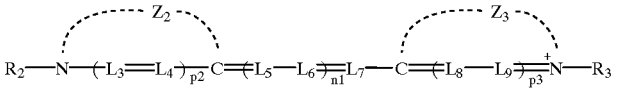

(II)

$M_2m_2$ wherein $L_3$, $L_4$, $L_5$, $L_6$, $L_7$, $L_8$ and $L_9$ each represents a methine group; $p_2$ and $p_3$ each represents 0 or 1; $n_1$ represents 0, 1, 2 or 3; $Z_2$ and $Z_3$ each represents an atomic group necessary for forming a 5- or 6-membered nitrogen-containing heterocyclic ring, provided that the heterocyclic ring may be condensed with an aromatic ring; $M_2$ represents a charge balancing counter ion; $m_2$ represents a number of from 0 to 4 necessary for neutralizing the molecular charge; $R_2$ and $R_3$ each represents an alkyl group, provided that at least one of $R_2$ and $R_3$ is an alkyl group represented by $R_1$ shown below:

$R_1$=—A—$CO_2^-$ wherein A has the same meaning as defined in formula (I);

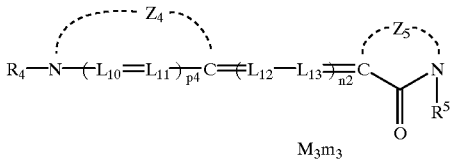

(III)

$M_3m_3$ wherein $L_{10}$, $L_{11}$, $L_{12}$ and $L_{13}$ each represents a methine group; $p_4$ represents 0 or 1; $n_2$ represents 0, 1, 2 or 3; $Z_4$ and $Z_5$ each represents an atomic group necessary for forming a 5- or 6-membered nitrogen-containing heterocyclic ring, provided that the ring in $Z_4$ may further be condensed with an aromatic ring; $M_3$ represents a charge balancing counter ion; $m_3$ represents a number of from 0 to 4 necessary for neutralizing the molecular charge; $R_4$ is the same as $R_1$; and $R_5$ represents an alkyl group, an aryl group or a heterocyclic group;

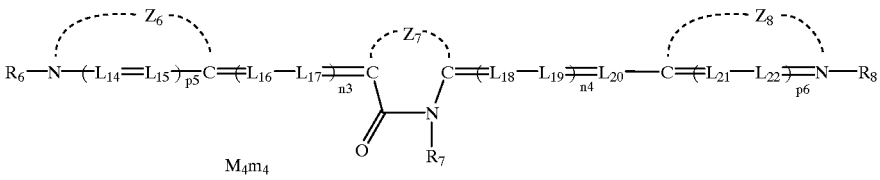

(IV)

$M_4m_4$ wherein $L_{14}$, $L_{15}$, $L_{16}$, $L_{17}$, $L_{18}$, $L_{19}$, $L_{20}$, $L_{21}$ and $L_{22}$ each represents a methine group; $p_5$ and $p_6$ each represents 0 or 1; $n_3$ and $n_4$ each represents 0, 1, 2 or 3; $Z_6$, $Z_7$ and $Z_8$ each represents an atomic group necessary for forming a 5- or 6-membered nitrogen-containing heterocyclic ring, provided that $Z_6$ or $Z_8$ may be condensed with an aromatic ring; $M_4$ represents a charge balancing counter ion; $m_4$ represents a number of from 0 to 4 necessary for neutralizing the molecular charge; $R_6$ and $R_8$ each represents an alkyl group; and $R_7$ represents an alkyl group, an aryl group or a heterocyclic group, provided that at least one of $R_6$ and $R_8$ is an alkyl group represented by $R_1$ above.

* * * * *